US008178274B2

(12) United States Patent
Agur et al.

(10) Patent No.: US 8,178,274 B2
(45) Date of Patent: May 15, 2012

(54) TONER PROCESS

(75) Inventors: Enno E. Agur, Toronto (CA); Daryl W. Vanbesien, Burlington (CA); Ke Zhou, Mississauga (CA); Michael S. Hawkins, Cambridge (CA); Maria N. V. McDougall, Oakville (CA); Richard P. N. Veregin, Mississauga (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 861 days.

(21) Appl. No.: 12/176,558

(22) Filed: Jul. 21, 2008

(65) Prior Publication Data

US 2010/0015544 A1 Jan. 21, 2010

(51) Int. Cl.
*G03G 9/00* (2006.01)

(52) U.S. Cl. ..... 430/137.14; 430/108.1; 430/108.2; 430/108.23; 430/110.2

(58) Field of Classification Search ..... 430/137.14, 430/108.1, 108.2, 108.23, 108.5, 110.2
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,672 | A | 11/1981 | Lu |
| 4,560,635 | A | 12/1985 | Hoffend et al. |
| 4,935,326 | A | 6/1990 | Creatura et al. |
| 4,937,166 | A | 6/1990 | Creatura et al. |
| 5,114,821 | A | 5/1992 | Haack |
| 5,236,629 | A | 8/1993 | Mahabadi et al. |
| 5,266,439 | A | 11/1993 | Sacripante et al. |
| 5,278,020 | A | 1/1994 | Grushkin et al. |
| 5,290,654 | A | 3/1994 | Sacripante et al. |
| 5,330,874 | A | 7/1994 | Mahabadi et al. |
| 5,346,790 | A | 9/1994 | Sacripante et al. |
| 5,346,797 | A | 9/1994 | Kmiecik-Lawrynowicz et al. |
| 5,364,729 | A | 11/1994 | Kmiecik-Lawrynowicz et al. |
| 5,387,489 | A | 2/1995 | Fuller et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,622,802 | A | 4/1997 | Demizu et al. |
| 5,650,255 | A | 7/1997 | Ng et al. |
| 5,650,256 | A | 7/1997 | Veregin et al. |
| 5,763,133 | A | 6/1998 | Ong et al. |
| 5,853,943 | A | 12/1998 | Cheng et al. |
| 5,989,770 | A | 11/1999 | Ugai et al. |
| 6,063,827 | A | 5/2000 | Sacripante et al. |
| 6,165,668 | A | 12/2000 | Wilson et al. |
| 6,184,387 | B1 | 2/2001 | Wilson et al. |
| 6,196,467 | B1 | 3/2001 | Dushane et al. |
| 6,207,335 | B1 | 3/2001 | Michel et al. |
| 6,214,507 | B1 | 4/2001 | Sokol et al. |
| 6,326,113 | B1 | 12/2001 | Okuda et al. |
| 6,593,049 | B1 | 7/2003 | Veregin et al. |
| 6,610,454 | B2 | 8/2003 | Hashimoto et al. |
| 6,756,176 | B2 | 6/2004 | Stegamat et al. |
| 6,762,004 | B2 | 7/2004 | Yamanaka et al. |

(Continued)

*Primary Examiner* — Christopher Rodee
*Assistant Examiner* — Stewart Fraser

(57) ABSTRACT

The present disclosure provides toners and processes for preparing toner particles possessing excellent charging characteristics. The process includes forming a dispersion including at least one organic and/or organometallic charge control agent, and then combining that dispersion with an emulsion suitable for use in forming toner particles.

13 Claims, 1 Drawing Sheet

U.S. PATENT DOCUMENTS

| | | | | |
|---|---|---|---|---|
| 6,830,859 | B2 | 12/2004 | Shiraishi et al. | |
| 6,830,860 | B2 | 12/2004 | Sacripante et al. | |
| 6,849,371 | B2 | 2/2005 | Sacripante et al. | |
| 6,908,720 | B2 | 6/2005 | Kenmoku et al. | |
| 6,977,129 | B2 | 12/2005 | Saito et al. | |
| 7,074,541 | B2 | 7/2006 | Yamashita et al. | |
| 7,371,495 | B2 | 5/2008 | Sato | |
| 2003/0180642 | A1 | 9/2003 | Isoda et al. | |
| 2005/0208409 | A1 | 9/2005 | Yasumatsu et al. | |
| 2006/0188801 | A1 | 8/2006 | Guistina et al. | |
| 2006/0222991 | A1 | 10/2006 | Sacripante et al. | |
| 2006/0251977 | A1 | 11/2006 | Kim | |
| 2006/0257776 | A1 | 11/2006 | Yasumatsu et al. | |
| 2007/0099103 | A1 | 5/2007 | Guistina et al. | |
| 2007/0224532 | A1 | 9/2007 | Vanbesien et al. | |
| 2007/0269730 | A1 | 11/2007 | Lee et al. | |
| 2008/0090163 | A1 * | 4/2008 | Agur et al. | 430/108.1 |
| 2009/0011355 | A1 * | 1/2009 | Shibai | 430/109.1 |

* cited by examiner

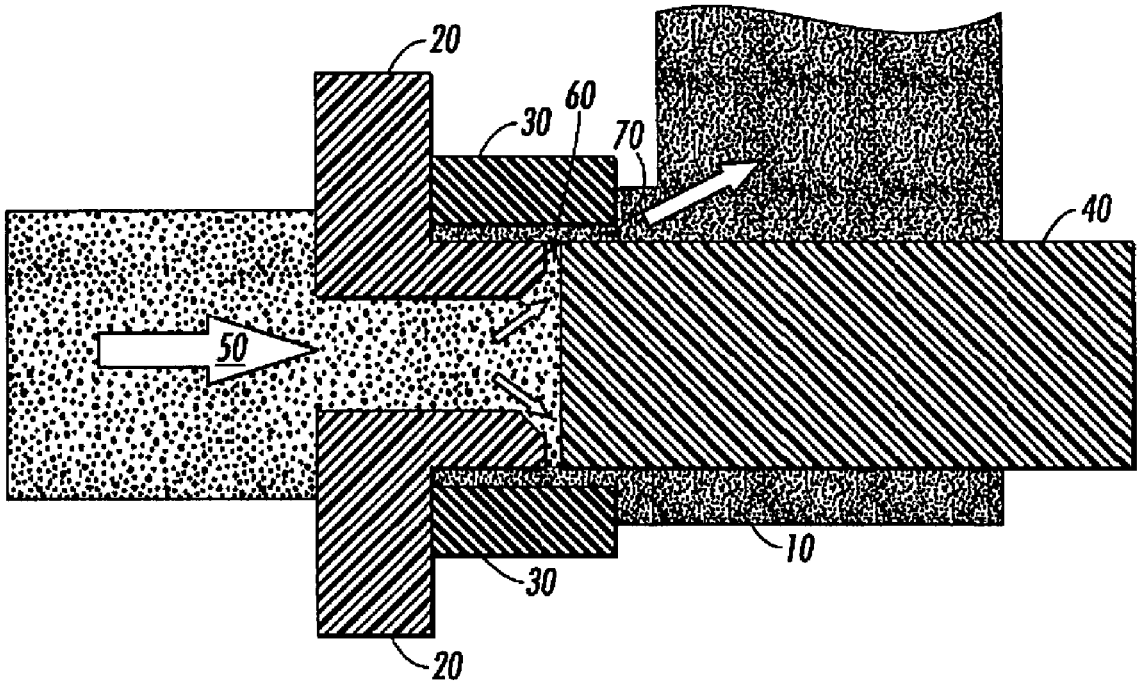
20
30
60
70
40
50
10
30
20

TONER PROCESS

BACKGROUND

The present disclosure relates to toners suitable for electrophotographic apparatuses and processes for making such toners.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Polyester EA low melting toners, including ultra low melting (ULM) toners having desired low temperature fusing performance, have been prepared utilizing amorphous and crystalline polyester resins wherein the addition of the crystalline polyester resin to the amorphous polyester resin imparts a lower melting temperature to the polyester toner. An example of such a low melting polyester toner is described in, for example, U.S. Pat. No. 6,830,860, the disclosure of which is hereby incorporated by reference in its entirety. However, the addition of the crystalline polyester resin to the amorphous polyester resin may cause a lowering of the charging performance of the toner, particularly in higher temperature and/or higher humidity conditions. This may be due, in part, to the crystalline component migrating to the surface of the toner particle during coalescence at a temperature around the melting point of the crystalline resin and interfering with toner charging in high temperature and/or high humidity conditions.

It is known that charge control agents (CCAs) such as organic and/or organometallic complexes may improve the charging performance of conventional melt mixed toners wherein (i) the CCA is added internally to the toner formulation during the melt mixing process, or (ii) blended externally to the toner surface together with other external additives, for example silica and/or titania particles. For EA toners, the challenge of incorporating similar CCAs into said EA toner formulations is heightened by the difficulty in reducing the CCAs to submicron size and incorporating said CCAs in an aqueous medium.

Means for improving toner charge independent of the selection of resin properties and process conditions remain desirable.

SUMMARY

The present disclosure provides processes for preparing toners, as well as toners prepared by such processes. In embodiments, processes of the present disclosure may include contacting at least one amorphous resin with at least one crystalline resin in an emulsion to form small particles, wherein the emulsion includes an optional colorant, an optional surfactant, and an optional wax, aggregating the small particles to form a plurality of larger aggregates, passing at least one charge control agent in a dispersion through a high energy disperser at a pressure of from about 3,000 pounds per square inch to about 30,000 pounds per square inch to form a charge control dispersion, contacting the larger aggregates with the charge control dispersion to form a resin coating thereon, coalescing the larger aggregates to form toner particles, and recovering the toner particles.

Toners of the present disclosure may include, in embodiments, a core including at least one amorphous resin, at least one crystalline resin, and one or more optional ingredients such as colorants, waxes, and combinations thereof, and a shell including at least one resin which may be the same or different as the at least one amorphous resin and at least one crystalline resin in the core, in combination with at least one charge control agent such as organic complexes and organometallic complexes.

In other embodiments, processes of the present disclosure may include contacting at least one amorphous resin with at least one crystalline resin, an optional colorant, at least one surfactant, and an optional wax to form small particles, and aggregating the small particles to form a plurality of larger aggregates. The process may also include forming a dispersion including at least one charge control agent such as amorphous iron complex salts having a monoazo compound as a ligand, azo-type iron complexes, 3,5-di-tert-butylsalicylic acid, zirconium complexes 3,5-di-t-butylsalicylic acid zinc compounds of 3,5-di-tert-butylsalicylic acid, zinc dialkyl salicylic acid, boro bis(1,1-diphenyl-1-oxo-acetyl potassium salt), zirconium complexes of 2-hydroxy-3-naphthoic acid, metal compounds having aromatic dicarboxylic acids as ligands, potassium borobisbenzylate, styrene-acrylate-based copolymers with sulfonate groups, styrene-methacrylate-based copolymers with sulfonate groups, complexes of dimethyl sulfoxide with metal salts, N-substituted 2-(1,2-benzisothiazol-3(2H)-ylidene 1,1-dioxide)acetamide, N-(2-(1,2-benzisothiazol-3(2H)-ylidene 1,1-dioxide)-2-cyanoacetyl) benzenesulfonamide, cetyltrimethylammonium bromide, cetyl pyridinium tetrafluoroborates, distearyl dimethyl ammonium methyl sulfate, distearyl dimethyl ammonium bisulfate, and combinations thereof, and passing the at least one charge control agent in a dispersion through a homogenizer at a pressure of from about 15,000 pounds per square inch to about 25,000 pounds per square inch. The larger aggregates may be contacted with the at least one charge control agent in the dispersion to form a resin coating thereon, the larger aggregates may be coalesced to form toner particles, and the toner particles may be recovered, wherein the toner particles are of a size of from about 3 micrometers to about 20 micrometers, and have a circularity of from about 0.9 to about 1.

BRIEF DESCRIPTION OF THE DRAWINGS

Various embodiments of the present disclosure will be described herein below with reference to the FIGURE wherein:

The FIGURE is a depiction of a homogenizing valve assembly which may be utilized to form a dispersion of the present disclosure possessing a charge control agent.

DETAILED DESCRIPTION

In embodiments of the present disclosure, toner particles may be prepared utilizing chemical processes which involve the aggregation and fusion of a latex resin with a charge control agent, an optional colorant, an optional wax and other optional additives.

In embodiments, a process of the present disclosure may be utilized to disperse charge control agents (CCA) comprising organic and/or organometallic complexes into aqueous surfactant solutions using high pressure homogenization. The resulting dispersed CCA may then be incorporated into EA low melting toners, including ultra low melting toners. Advantages of incorporating CCAs into EA toner designs include the improvement in toner charge and heat cohesion performance for the resulting toner, even though there may be a small increase in toner melting temperature resulting in a small decrease in fusing performance.

In embodiments, the toners herein may be low melt or ultra low melt toners. A low melt or ultra low melt toner may have a glass transition temperature of, for example, from about 45° C. to about 85° C., in embodiments from about 50° C. to about 65° C., or in embodiments about 55° C. to about 60° C. Such toners may also exhibit a desirably low fixing or fusing temperature, for example a minimum fusing temperature of from about 75° C. to about 150° C., in embodiments from about 80° C. to about 145° C., or in embodiments from about 90° C. to about 130° C. Such low melt characteristics are desirable in enabling the toner to be fixed or fused onto an image receiving substrate such as paper at a lower temperature, which can result in energy savings as well as increased device speed.

Resins

Any latex resin may be utilized in forming a toner of the present disclosure. Such resins, in turn, may be made of any suitable monomer. Suitable monomers useful in forming the resin include, but are not limited to, styrenes, acrylates, methacrylates, butadienes, isoprenes, acrylic acids, methacrylic acids, acrylonitriles, diol, diacid, diamine, diester, mixtures thereof, and the like. Any monomer employed may be selected depending upon the particular polymer to be utilized.

In embodiments, a polymer utilized to form a resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety. Further, for example, suitable resins may include combinations of two or more polyester resins, for example, at least one crystalline polyester with at least one amorphous polyester.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate). Examples of polyamides include poly(ethylene-adipamide), poly(propylene-adipamide), poly(butylenes-adipamide), poly(pentylene-adipamide), poly(hexylene-adipamide), poly (octylene-adipamide), poly(ethylene-succinamide), and poly (propylene-sebecamide). Examples of polyimides include poly(ethylene-adipimide), poly(propylene-adipimide), poly (butylene-adipimide), poly(pentylene-adipimide), poly (hexylene-adipimide), poly(octylene-adipimide), poly(ethylene-succinimide), poly(propylene-succinimide), and poly (butylene-succinimide). The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. as measured, for example, by Differential Scanning Calorimetry (DSC). The crystalline resin may have a number average molecular weight ($M_n$), of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography (GPC) using polystyrene standards. The molecular weight distribution ($M_w/M_n$) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, trimellitic acid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include poly(styrene-acrylate) resins, crosslinked, for example, from about 10 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins.

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable amorphous polyester resin may be a poly(propoxylated bisphenol A co-fumarate) resin having the following formula (I):

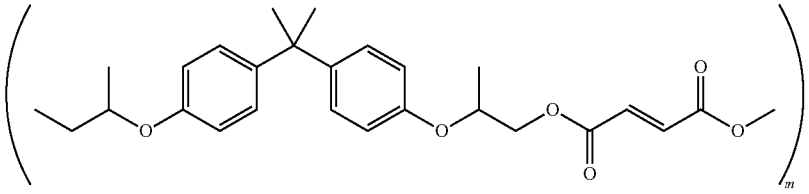

(I)

wherein m may be from about 5 to about 1000.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold Inc., Research Triangle Park, N.C. and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

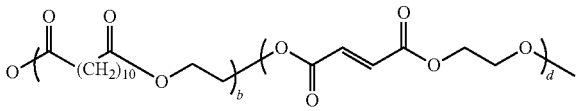

(II)

wherein b is from 5 to 2000 and d is from 5 to 2000.

One, two, or more toner resins may be used. In embodiments where two or more toner resins are used, the toner resins may be in any suitable ratio (for example, weight ratio) such as for instance about 10 percent first resin/90 percent second resin, to about 90 percent first resin/10 percent second resin. In embodiments, the amorphous resin utilized in the core may be linear.

In embodiments, the resin may be formed by emulsion polymerization methods. In other embodiments, a pre-made resin may be utilized to form the toner.

While crystalline polyester resins in toners alone may provide excellent low melt and high gloss performance, they may also provide poor fusing latitude. Similarly, amorphous polyester resins in toners alone may provide excellent release performance, their low melt performance may be limited by blocking and document offset requirements. By combining both crystalline and amorphous resins, one can achieve desired low temperature fusing performance and wide fusing latitude. Thus, as noted above, in embodiments a resin utilized in forming toner particles may include both an amorphous resin and a crystalline resin.

The resin described above may be utilized to form toner compositions. Such toner compositions may include CCAs, optional colorants, optional waxes, and other optional additives. Toners may be formed utilizing any method within the purview of those skilled in the art.

In embodiments, the above resins, as well as any CCAs, colorants, waxes, and other additives utilized to form toner compositions, may be in latexes, emulsions or dispersions including surfactants. Moreover, toner particles may be formed by emulsion aggregation (EA) methods where the resin and other components of the toner in the form of latexes, emulsions or dispersions are mixed, aggregated, coalesced, optionally washed and dried, and recovered.

Surfactants may be added to the constituent components (resins, pigments, waxes, CCAs, and the like) during emulsification or dispersion in aqueous media in order to stabilize the said emulsion or dispersion, that is, to lower the interfacial tension between dispersed phase and aqueous phase during emulsification or dispersion and to prevent reagglomeration of the dispersed phase prior to addition into toner formulation. Once added to the toner mixture the surfactants further contribute to the ionic charge (neutral, positive or negative) of the said emulsion or dispersion to enable aggregation of said toner components optionally in the presence of a coagulant. In embodiments, the constituent components may be stabilized with anionic surfactants and the coagulant may be cationic.

One, two, or more surfactants may be utilized in said latexes, emulsions and dispersions in order to stabilize said mixtures and to provide ionic charge to assist aggregation of said toner components during toner aggregation. Any type of surfactant may be used, with anionic, cationic or nonionic surfactants being utilized in some embodiments.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Industries SA as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecyinaphthalene sulfate, dialkyl benzenealkyl sulfates and sulfonates, acids such as abitic acid available from Aldrich, NEOGEN R™, NEOGEN SC™ obtained from Daiichi Kogyo Seiyaku Co. Ltd., combinations thereof, and the like. Other suitable anionic surfactants include, in embodiments, DOWFAX™ 2A1, an alkyldiphenyloxide disulfonate from The Dow Chemical Company, and/or TAYCAPOWER BN2060 from Tayca Corporation, which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Corporation, and the like, and mixtures thereof.

Charge Control Agents

As noted above, in embodiments, the resin utilized to form a toner may include an amorphous polyester in combination with a crystalline polyester. Although many of these toners may have excellent fusing performance, in some cases the toners may have poor charging performance. While not wishing to be bound by any theory, this poor charging performance may be due to the crystalline component migrating to the particle surface during the coalescence stage of EA particle formation.

Thus, in embodiments, it may be desirable to incorporate a charge control agent (CCA) into the toner formulation. Suitable negative or positive charge CCAs may include, in embodiments, organic and/or organometallic complexes. For example, negative CCAs may include azo-metal complexes, for instance, VALIFAST® BLACK 3804, BONTRON® S-31, BONTRON® S-32, BONTRON® S-34, BONTRON® S-36, (commercially available from Orient Chemical Industries, Ltd.), T-77, AIZEN SPILON BLACK TRH (commercially available from Hodogaya Chemical Co., Ltd.); amorphous metal complex salt compounds with monoazo compounds as ligands, including amorphous iron complex salts having a monoazo compound as a ligand (see, for example, U.S. Pat. No. 6,197,467, the disclosure of which is hereby incorporated by reference in its entirety); azo-type metal complex salts including azo-type iron complexes (see, for example, U.S. Patent Application No. 2006/0257776, the disclosure of which is hereby incorporated by reference in its entirety); monoazo metal compounds (see, for example, U.S. Patent Application No. 2005/0208409, the disclosure of which is hereby incorporated by reference in its entirety); copper phthalocyanine complexes; carboxylic acids, substituted carboxylic acids and metal complexes of said acids; salicylic acid, substituted salicylic acid, and metal complexes of said acids, including 3,5-di-tert-butylsalicylic acid; metal complexes of alkyl derivatives of salicylic acid, for instance, BONTRON® E-81, BONTRON® E-82, BONTRON® E-84, BONTRON® E-85, BONTRON® E-88 (commercially available from Orient Chemical Industries, Ltd.); metal complexes of alkyl-aromatic carboxylic acids, including zirconium complexes of alkyl-aromatic carboxylic acids, such as 3,5-di-t-butylsalicylic acid (see, for example, U.S. Pat. No. 7,371,495, the disclosure of which is hereby incorporated by reference in its entirety); zinc compounds of alkylsalicylic acid derivatives including zinc compounds of 3,5-di-tert-butylsalicylic acid (see, for example, U.S. Patent Application No. 2003/0180642, the disclosure of which is hereby incorporated by reference in its entirety); salicylic acid compounds including metals or boron complexes including zinc dialkyl salicylic acid or boro bis(1,1-diphenyl-1-oxo-acetyl potassium salt) (see, for example, U.S. Patent Application No. 2006/0251977, the disclosure of which is hereby incorporated by reference in its entirety); naphthoic acids, substituted naphthoic acids and metal complexes of said acids including zirconium complexes of 2-hydroxy-3-naphthoic acid (see, for example, U.S. Pat. No. 7,371,495, the disclosure of which is hereby incorporated by reference in its entirety); hydroxycarboxylic acids, substituted hydroxycarboxylic acids and metal complexes of said acids including metal compounds having aromatic hydroxycarboxylic acids as ligands (see, for example, U.S. Pat. No. 6,326,113, the disclosure of which is hereby incorporated by reference in its entirety); dicarboxylic acids, substituted dicarboxylic acids and metal complexes of said acids including metal compounds having aromatic dicarboxylic acids as ligands (see, for example, U.S. Pat. No. 6,326,113, the disclosure of which is hereby incorporated by reference in its entirety); nitroimidazole derivatives; boron complexes of benzilic acid including potassium borobisbenzylate, for instance LR-147 (commercially available from Japan Carlit Co., Ltd.); calixarene compounds, for instance BONTRON® E-89 and BONTRON® F-21 (commercially available from Orient Chemical Industries, Ltd.); metal compounds obtainable by reacting one or two or more molecules of a compound having a phenolic hydroxy group, including calixresorcinarenes or derivatives thereof and one or two or more molecules of a metal alkoxide (see, for example, U.S. Pat. No. 6,762,004, the disclosure of which is hereby incorporated by reference in its entirety); metal carboxylates and sulfonates (see, for example, U.S. Pat. No. 6,207,335, the disclosure of which is hereby incorporated by reference in its entirety); organic and/or organometallic compounds containing sulfonates including copolymers selected from styrene-acrylate-based copolymers and styrene-methacrylate-based copolymers with sulfonate groups (see, for example, U.S. Patent Application No. 2007/0269730, the disclosure of which is hereby incorporated by reference in its entirety); sulfone complexes comprising alkyl and/or aromatic groups (see, for example, U.S. Patent Application No. 2007/0099103, the disclosure of which is hereby incorporated by reference in its entirety); organometallic complexes of dimethyl sulfoxide with metal salts (see, for example, U.S. Patent Application No. 2006/0188801, the disclosure of which is hereby incorporated by reference in its entirety); calcium salts of organic acid compounds having one or more acid groups including carboxyl groups, sulfonic groups and/or hydroxyl groups (see, for example, U.S. Pat. No. 6,977,129, the disclosure of which is hereby incorporated by reference in its entirety); barium salts of sulfoisophthalic acid compounds (see, for example, U.S. Pat. No. 6,830,859, the disclosure of which is hereby incorporated by reference in its entirety); polyhydroxyalkanoates comprising substituted phenyl units (see, for example, U.S. Pat. No. 6,908,720, the disclosure of which is hereby incorporated by reference in its entirety); acetamides including N-substituted 2-(1,2-benzisothiazol-3(2H)-ylidene 1,1-dioxide)acetamide (see, for example, U.S. Pat. No. 6,184,387, the disclosure of which is hereby incorporated by reference in its entirety); benzenesulfonamides including N-(2-(1,2-benzisothiazol-3(2H)-ylidene 1,1-dioxide)-2-cyanoacetyl)benzenesulfonamide (see, for example, U.S. Pat. No. 6,165,668, the disclosure of which is hereby incorporated by reference in its entirety); combinations thereof, and the like.

Positive CCAs which may be utilized include Nigrosine compounds, for instance, NIGROSINE BASE EX, OIL BLACK BS, OIL BLACK SO, BONTRON® N-01, BONTRON® N-04, BONTRON® N-07, BONTRON® N-09, BONTRON® N-11, BONTRON® N-21 (commercially available from Orient Chemical Industries, Ltd.); triphenylmethane-based compounds containing a tertiary amine as a side chain; quaternary ammonium salt compounds, for instance, BONTRON® P-51, BONTRON® P-52 (commercially available from Orient Chemical Industries, Ltd.), TP415, TP-302, TP-4040 (commercially available from Hodogaya Chemical Co., Ltd.), COPY CHARGE PSY (commercially available from Clariant Ltd.); cetyltrimethylammonium bromide, COPY CHARGE PX VP435 (commercially available from Clariant Ltd.); alkyl pyridinium halides including cetyl pyridinium tetrafluoroborates; alkyl pyridinium compounds (see, for example, U.S. Pat. No. 4,298,672, the disclosure of which is hereby incorporated by reference in its entirety); organic sulfate and sulfonate compositions, for instance distearyl dimethyl ammonium methyl sulfate (DDAMS) (see, for example, U.S. Pat. No. 4,560,635, the disclosure of which is hereby incorporated by reference in its entirety); bisulfates including distearyl dimethyl ammonium bisulfate (DDABS) (see, for example, U.S. Pat. No. 5,114,821, the disclosure of which is hereby incorporated by reference in its entirety); quaternary ammonium nitrobenzene sulfonates; polyamine resins, for instance, AFP-B (commercially available from Orient Chemical Industries, Ltd.); guanidine derivatives; imidazole derivatives, for instance, PLZ-2001, PLZ-8001 (commercially available from Shikoku Kasei K.K.); combinations thereof, and the like.

In embodiments, a CCA may be in an emulsion or dispersion including water and/or any surfactant described above. The CCA dispersion, in turn, may be combined with an emulsion or dispersion possessing at least one resin. In embodiments, a CCA dispersion may be formed using a high energy disperser, including high pressure homogenizers commercially available from APV Homogeniser Group and/or Niro Soavi North America, LLC, an ULTIMAIZER™ high shear disperser available from Sugino Machine Ltd., a MICROFLUIDIZER® high shear processor available from Microfluidics, a division of MFIC Corporation, a CAVITRON™ high energy stator/rotor mixer available from Arde-Barinco Inc., combinations thereof, and the like. Still other dispersion technologies may be utilized in accordance with the present disclosure, such as impeller mills including agitators and blenders, ball mills including pebble mills and attritors, small-media mills including sand mills, vibratory mills, multiple roll mills, ultrasonic dispersers, combinations thereof, and the like.

As used herein, high pressure homogenization may include the process of producing emulsions or dispersions in a fluid mixture under pressure. The process of high pressure homogenization may include at least two factors in order to produce a stable dispersion product: (i) generation of high forces to break up or disperse the solid aggregates in the fluid mixture; and (ii) stabilization of said dispersion product to prevent reagglomeration of the dispersed solid particles in the fluid mixture.

For example, a solid charge control agent may be dispersed in water by high pressure homogenization to form an aqueous CCA dispersion. This CCA dispersion may then be incorporated into a EA toner formulation in order to improve charging performance of the toner.

As noted above, in high pressure homogenization, surfactants may be used to stabilize the solid dispersion product.

Any surfactant described above as suitable for the emulsion aggregation process may be utilized. Functions of the surfactant may include: (i) lowering the interfacial tension between the dispersed solid and the aqueous phase; and (ii) preventing agglomeration of the dispersed particles after they are formed. For application in EA toner processes, another function of the surfactant may be to provide an ionic charge, positive, neutral or negative, to the resulting solid particles in the dispersion mixture. Depending on the charges of the other constituent components (resin, pigment, and the like) in the toner formulation, it may be desirable to choose a particular surfactant based on its ionic character for optimum aggregation coalescence performance. Cationic surfactants may provide a net positive charge to the dispersed particles in a toner mixture, whereas anionic surfactants may provide a net negative charge. As noted above, any suitable surfactant may be utilized. In embodiments, suitable anionic surfactants include TAYCAPOWER BN 2060 which is a branched sodium dodecylbenzene sulfonate from Tayca Corporation.

The amount of surfactant or required to stabilize the CCA dispersion depends on the structure of the CCA itself. As a general guideline, amounts of surfactants to produce a stable CCA dispersion are in the range of from about 1 to about 20 parts per hundred surfactant-to-CCA, preferably from about 5 to about 10 parts per hundred surfactant-to-CCA.

A CCA may be present in a dispersion of the present disclosure in an amount from about 5 percent by weight to about 50 percent by weight of the dispersion, in embodiments from about 15 percent by weight to about 30 percent by weight of the dispersion.

In accordance with the present disclosure, a CCA dispersion may be formed utilizing a high pressure homogenizer. Turning now to the FIGURE, which depicts a homogenizing valve assembly 10, an exemplary process of forming a CCA dispersion may include the following. To disperse a mixture of solid aggregates in water, the unhomogenized pre-mixture 50 of solids and water may first enter the valve seat 20 of valve assembly 10 at a relatively low velocity, but at a high pressure. For example, the pressure may be from about 3,000 pounds per square inch (20 megapascals) to about 30,000 pounds per square inch (200 megapascals), in embodiments from about 15,000 pounds per square inch to about 25,000 pounds per square inch. The pre-mixture travels from left to right through the valve so that it exits through the gap 60 between the valve seat 20 and valve 40. After impinging on impact ring 30, the homogenized product exits from the valve assembly area through gap 70. In embodiments, the homogenization valve 40 may be forced from right to left against the valve seat 20 to assist in homogenization of the CCA dispersion.

The pressure in the valve may be generated by an upstream positive displacement pump (not shown) and the restriction of flow caused by the valve 40 being forced against the valve seat 20. Due to the very small gap, the liquid mixture accelerates to a very high velocity in this region. As the velocity increases, the pressure decreases producing an instantaneous pressure drop. The fluid mixture then impinges on the impact ring 30 and is finally discharged as homogenized (or dispersed) product.

In the very short period of time that the fluid mixture travels through the gap 60 between the valve seat 20 and valve 40, it is thought that at least two processes may take place that dissipate the large amount of energy to the liquid and thus may be responsible for the homogenization of the fluid mixture. First, cavitation may occur. The cavitation bubbles formed when the pressure drop is large may result in shock waves that break apart the dispersed droplets or solid aggregates. Secondly, the energy dissipated in the fluid generates intense turbulent eddies having the same size as the average droplet (or particle) diameter. The intense energy of the turbulence and the localized pressure differences may tear apart the droplets or solid aggregates.

In the case of solid powders, including CCAs for EA toner applications as stated above, higher pressures may be needed for forming a dispersion, for example, from about 3,000 pounds per square inch (20 megapascals) to about 30,000 pounds per square inch (200 megapascals), in embodiments from about 15,000 pounds per square inch (100 megapascals) to about 25,000 pounds per square inch (170 megapascals). In addition to the homogenizer depicted in the FIGURE and as described above, suitable homogenizers which may be utilized to form such dispersion include, but are not limited to, those commercially available as the RANNIE LAB 2000 high pressure homogenizer from APV Homogeniser Group which can generate pressures as high as about 30,000 pounds per square inch (200 megapascals) with a throughput rate of about 11 liters per minute. As larger models of these machines can generate pressures only as high as from about 15,000 to about 22,000 pounds per square inch (100 to 150 megapascals), for similar solid powder applications it may be desirable to utilize multiple passes of the materials through the homogenizer, for example from about 5 to about 40 passes, in embodiments from about 10 to about 30 passes, depending on the nature of the solid powder.

Due to the high energy input during homogenization, it may be desirable to cool the product between homogenization passes. For example, for water, the heat generated during homogenization may result in a temperature rise per pass of about 17° C. for each 10,000 pounds per square inch (70 megapascals) of homogenization pressure. Thus, in embodiments it may be desirable to cool the materials between passes to a temperature of from about 5° C. to about 50° C., in embodiments from about 10° C. to about 40° C.

Thus, in embodiments, the present disclosure may be utilized to incorporate CCAs into EA ULM toner formulations in the form of aqueous dispersions. The particle size of the CCA in such a dispersion may be from about 100 nanometers to about 500 nanometers in diameter, in embodiments from about 200 nanometers to about 400 nanometers in diameter as measured, for example, with a Microtrac UPA150 particle size analyzer. The particle size obtained may be adjusted by the materials utilized in forming the dispersion and the homogenization conditions.

In accordance with the present disclosure, a CCA dispersion may be prepared separately, rather than in combination with one or more other toner components. This may have the advantage of providing greater formulation and process flexibility when toner components are available separately rather than as mixtures. For example, forming a separate dispersion with a CCA may permit tuning of the toner charge, independent of process changes. It may also be more economical to obtain components commercially separately than as mixtures in resins or the like.

As noted above, the CCA dispersion may then be added to a resin, optional colorant, optional wax, each of which may also be in a dispersion, and other additives to form toner particles. The toner particles thus produced may have a charge control agent in an amount of from about 0.1 to about 10 percent by weight of the toner, in embodiments from about 1 to about 3 percent by weight of the toner.

Colorants

As the optional colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin, charge control agent, and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical Corporation and Baker Petrolite Polymers Division, Baker Hughes Inc., for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from S.C. Johnson & Son, Inc., and chlorinated polypropylenes and polyethylenes available from Allied Chemical Corporation, Baker Petrolite and S.C. Johnson & Son, Inc. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional colorant, an optional wax and any other desired or required additives, emulsions including one or more of the resin latexes described above, and optionally including charge control agent dispersions as described above, optionally in surfactants as described above, and then coalescing the aggregate mixture. The optional colorant and optional wax or other materials, may also be in a dispersion(s) and/or emulsion(s). The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer from IKA Works Inc. It should be noted that probe homogenization, for example with an IKA ULTRA TURRAX T50 probe homogenizer, utilizes significantly less shear and energy than is required in high pressure homogenization utilizing, for example, a RANNIE LAB 2000 piston homogenizer for dispersing CCAs in an aqueous mixture.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1 percent to about 8 percent by weight, in embodiments from about 0.2 percent to about 5 percent by weight, in other embodiments from about 0.5 percent to about 5 percent by weight, of the resin in the mixture. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 revolutions per minute (rpm) to about 1,000 revolutions per minute, in other embodiments from about 100 revolutions per minute to about 500 revolutions per minute, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

In some embodiments, a shell may be applied to the formed aggregated toner particles. Any resin described above as suitable for the core resin may be utilized as the shell resin. In embodiments, the CCA dispersion described above may be added to the shell resin and applied to the toner as a shell. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as low or ultra low melt toners. In embodiments, the dry toner particles, exclusive of external surface additives, may have the following characteristics:

(1) Volume average diameter (also referred to as "volume average particle diameter") of from about 3 to about 20 micrometers, in embodiments from about 4 to about 15 micrometers, in other embodiments from about 5 to about 9 micrometers as measured, for example, with a Coulter counter.

(2) Number Average Geometric Standard Deviation (GSDn) and/or Volume Average Geometric Standard Deviation (GSDv) of from about 1.05 to about 1.55, in embodiments from about 1.1 to about 1.4 as measured, for example, with a Coulter counter.

(3) Circularity of from about 0.9 to about 1, in embodiments form about 0.95 to about 0.985, in other embodiments from about 0.96 to about 0.98 as measured with, for example, a Sysmex FPIA 2100 analyzer.

(4) Glass transition temperature of from about 40° C. to about 65° C., in embodiments from about 55° C. to about 62° C. as measured by, for example, differential scanning calorimetry (DSC).

In further embodiments, the toner may have a relative humidity sensitivity of, for example, from about 0.5 to about 10, in embodiments from about 0.5 to about 5. Relative humidity (RH) sensitivity is a ratio of the charging of the toner at high humidity conditions to charging at low humidity conditions. That is, the RH sensitivity is defined as the ratio of toner charge at 15 percent relative humidity and a temperature of about 12° C. (denoted herein as C-zone) to toner charge at 85 percent relative humidity and a temperature of about 28° C. (denoted herein as A-zone); thus, RH sensitivity is determined as (C-zone charge)/(A-zone charge). Ideally, the RH sensitivity of a toner is as close to 1 as possible, indicating that the toner charging performance is the same in low and high humidity conditions, that is, that the toner charging performance is unaffected by the relative humidity.

Toners prepared in accordance with the present disclosure also possess excellent heat cohesion/blocking performance and improved charging performance, with Q/m (Toner charge per mass ratio) in A- and C-zone of from about 10 microcoulombs per gram to about 50 microcoulombs per gram, in embodiments from about 20 microcoulombs per gram to about 40 microcoulombs per gram, and an onset of heat cohesion (HC) greater than about 50° C., and in embodiments greater than about 52° C.

In accordance with the present disclosure, the charging of the toner particles may be enhanced, so less surface additives may be required, and the final toner charging may thus be higher to meet machine charging requirements.

Developers

The toner particles may be formulated into a developer composition. The toner particles may be mixed with carrier particles to achieve a two-component developer composition. The toner concentration in the developer may be from about 1 percent to about 25 percent by weight of the total weight of the developer, in embodiments from about 2 percent to about 15 percent by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326, the disclosures of each of which are totally incorporated herein by reference.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 percent by weight to about 70 to about 30 percent by weight, in embodiments from about 40 to about 60 percent by weight to about 60 to about 40 percent by weight. The coating may have a coating weight of, for example, from about 0.1 to about 5 percent by weight of the carrier, in embodiments from about 0.5 to about 2 percent by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 micrometers in size, in embodiments from about 50 to about 75 micrometers in size, coated with about 0.5 percent to about 10 percent by weight, in embodiments from about 0.7 percent to about 5 percent by weight, of a conductive polymer mixture including, for example, methylacrylate and carbon black using the process described in U.S. Pat. Nos. 5,236,629 and 5,330,874, the disclosures of each of which are totally incorporated herein by reference.

The carrier particles can be mixed with the toner particles in various suitable combinations. The concentrations are may be from about 1 percent to about 20 percent by weight of the toner composition. However, different toner and carrier percentages may be used to achieve a developer composition with desired characteristics.

Imaging

The toners can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

CCA Dispersion

About 720 grams of deionized water, about 200 grams of BONTRON® E-84 CCA, which is a zinc complex of 3,5-di-tert-butylsalicylic acid in powder form obtained from Orient Chemical Industries, Ltd., and about 95.6 grams of a surfactant solution containing about 16 grams of TAYCAPOWER BN 2060 anionic surfactant, which is a branched sodium dodecylbenzene sulfonate commercially available from Tayca Corporation, and about 79.6 grams deionized water, were dispensed into a 4 liter glass beaker and stirred at a speed of about 200 revolutions per minute with the aid of a mechanical stirrer to mix the dry CCA powder, anionic surfactant solution and water. The resultant CCA mixture was predispersed for about 5 minutes using an IKA ULTRA TURRAX® T50 probe homogenizer operating at a speed starting at about 3,000 revolutions per minute and ending at about 7,000 revolutions per minute. The resulting predispersed CCA mixture was then further stirred at a speed of about 200 revolutions per minute overnight to deair the mixture and then poured into the feed hopper of a RANNIE LAB 2000 high pressure homogenizer. The homogenizer was turned on to pump the CCA mixture through the homogenizer at a rate of about 11 liters per hour. The product was collected in a product container wherein the container was cooled to room temperature by means of an ice bath. In the initial pass through the homogenizer, the primary and secondary valves of the homogenizer were kept substantially open, so the resulting homogenization pressure was less than 1,000 pounds per square inch (7 megapascals).

In subsequent passes, the homogenization pressure was gradually increased to about 20,000 pounds per square inch (135 megapascals) by partially closing the homogenizer primary valve. In total, the CCA mixture was pumped through the homogenizer about 18 times at about 20,000 pounds per square inch (135 megapascals) pressure. At the completion of homogenization, the homogenizer primary valve was opened and the homogenizer was disengaged.

The material thus obtained was a stable CCA dispersion including about 17.86 percent by weight of BONTRON®

E-84 CCA and about 1.43 percent by weight of TAYCA-POWER BN 2060 anionic surfactant as measured gravimetrically utilizing a hot plate. The CCA particles of the dispersion had a volume median diameter of about 291 nanometers as determined by a Microtrac UPA150 particle size analyzer.

Comparative Example 1

Toner with Wax, without CCA

This Comparative Example synthesized a polyester emulsion aggregation toner and a wax, but not including the CCA dispersion from Example 1. The following components were added to a 4 liter glass beaker: about 1,132 grams of deionized water; about 6.65 grams of DOWFAX™ 2A1 anionic surfactant, which is an alkyldiphenyloxide disulfonate commercially available from The Dow Chemical Company; about 230 grams of an amorphous polyester resin emulsion (Amorphous Resin Emulsion A) containing about 29.9 percent by weight of a linear amorphous polyester resin derived from terephthalic acid, dodecenylsuccinic acid, trimellitic acid, ethoxylated bisphenol A and propoxylated bisphenol A; about 237 grams of another amorphous polyester resin emulsion (Amorphous Resin Emulsion B) containing about 31.85 percent by weight of a linear amorphous polyester resin derived from terephthalic acid, fumaric acid, dodecenylsuccinic acid, ethoxylated bisphenol A and propoxylated bisphenol A; about 123 grams of a crystalline polyester resin emulsion containing about 17.8 percent by weight crystalline polyester resin derived from 1,12-dodecanedioic acid and 1,9-nonanediol; about 97 grams of a wax emulsion containing about 30.6 percent by weight FNP92 polymethylene wax available from Nippon Seiro Co., Ltd.; and about 111 grams of a cyan pigment dispersion containing about 17.2 percent by weight Pigment Blue 15:3 pigment. The pH of the mixture was adjusted to about 4.2 using a 0.3 M solution of $HNO_3$. The mixture was stirred using an IKA ULTRA TURRAX® T50 probe homogenizer operating at about a speed of from about 3,500 to about 4,000 revolutions per minute. During homogenization, about 64 grams of a flocculent mixture containing about 1 percent by weight solution of $Al_2(SO_4)_3$ was added dropwise. The mixture was subsequently transferred to a 3 liter glass kettle, and heated to about 40° C. for aggregation while mixing continued at about 450 revolutions per minute. The particle size was monitored with a Coulter Counter until the core particles reached a volume average particle size of about 5 micrometers and a volume average geometric standard deviation (GSDv) of about 1.23.

About 3.24 grams of DOWFAX™ 2A1 anionic surfactant, about 127 grams of Amorphous Resin Emulsion A adjusted to a pH of about 3.2, and about 131 grams of Amorphous Resin Emulsion B adjusted to a pH of about 3.2, were added to the reactor mixture to further aggregate until the particles reached a volume average particle size of about 5.7 micrometers and a GSDv of about 1.21.

Thereafter, the pH of the toner slurry was increased to about 7.5 using about 1 M NaOH followed by the addition of about 4.9 grams of a chelating solution containing about 39 percent by weight EDTA to freeze the toner growth. After freezing, the reactor mixture was heated to about 80° C. to enable the toner particles to coalesce and spherodize. The reactor heater was then turned off and the reactor mixture was rapidly cooled to room temperature with the addition of ice, and then filtered through a 25 micrometer sieve, washed and dried.

The final toner had a volume average particle size diameter of about 5.7 micrometers and a GSDv of about 1.21 as measured by a Coulter Counter, and a circularity of about 0.968 as measured with a SYSMEX® FPIA-2100 flow-type histogram analyzer.

Charging data are set forth below in Table 2.

Example 2

Toner with Wax and CCA

This Example synthesized a polyester emulsion aggregation toner including a wax and the CCA dispersion from Example 1. The following components were added to a 2 liter glass beaker: about 464.1 grams of deionized water; about 3.6 grams of DOWFAX™ 2A1 anionic surfactant; about 124.4 grams of an amorphous polyester resin emulsion (Amorphous Resin Emulsion A) containing about 29.9 percent by weight of a linear amorphous polyester resin derived from terephthalic acid, dodecenylsuccinic acid, trimellitic acid, ethoxylated bisphenol A and propoxylated bisphenol A; about 116.8 grams of amorphous polyester resin emulsion (Amorphous Resin Emulsion B) containing about 31.85 percent by weight of a linear amorphous polyester resin derived from terephthalic acid, fumaric acid, dodecenylsuccinic acid, ethoxylated bisphenol A and propoxylated bisphenol A; about 57.6 grams of a crystalline polyester resin emulsion containing about 17.8 percent by weight crystalline polyester resin derived from 1,12-dodecanedioic acid and 1,9-nonanediol; about 45.25 grams of wax emulsion containing about 30.6 percent by weight FNP92 polymethylene wax; and about 52.3 grams of a cyan pigment dispersion containing about 17.2 percent by weight Pigment Blue 15:3 pigment. The pH of the mixture was adjusted to about 4.2 using a 0.3 M solution of $HNO_3$. The mixture was stirred using an IKA ULTRA TURRAX® T50 probe homogenizer operating at about a speed of from about 3,500 to about 4,000 revolutions per minute. During homogenization, about 75 grams of a flocculent mixture containing about 1 percent by weight solution of $Al_2(SO_4)_3$ was added dropwise. The mixture was subsequently transferred to a 2 liter glass kettle, and heated to about 40° C. for aggregation while mixing continued at about 450 revolutions per minute. The particle size was monitored with a Coulter Counter until the core particles reached a volume average particle size of about 5 micrometers and a volume average geometric standard deviation (GSDv) of about 1.23.

About 1.79 grams of DOWFAX™ 2A1 anionic surfactant, about 70.2 grams of Amorphous Resin Emulsion A adjusted to a pH of about 3.2, about 65.9 grams of Amorphous Resin Emulsion B adjusted to a pH of about 3.2, and about 8.75 grams of the CCA dispersion produced in Example 1 above, were added to the reactor mixture to further aggregate until the particles reached a volume average particle size of about 5.7 micrometers and a GSDv of about 1.21.

Thereafter, the pH of the toner slurry was increased to about 7.5 using about 1 M NaOH followed by the addition of about 5.77 grams of a chelating solution containing about 39 percent by weight EDTA to freeze the toner growth. After freezing, the reactor mixture was heated to about 85° C. to enable the toner particles to coalesce and spherodize. The reactor heater was then turned off and the reactor mixture was rapidly cooled to room temperature with the addition of ice, and then filtered through a 25 micrometer sieve, washed and dried.

The final toner had a volume average particle size diameter of about 5.7 micrometers and a GSDv of about 1.22 as measured by a Coulter Counter, and a circularity of about 0.97 as measured with a SYSMEX® FPIA-2100 flow-type histogram analyzer.

Since the EDTA acted as a chelating agent, a determination was made of the zinc concentration in the final toner and in the first wash filtrate with a Thermo Electron iCAP 6500 ICP spectrometer, the results of which are shown below in Table 1. Charging data are set forth below in Table 2.

Comparative Example 2

This Comparative Example synthesized a polyester emulsion aggregation toner not including wax, and not including the CCA dispersion from Example 1. The following components were added to a 2 liter glass beaker: about 281.8 grams of deionized water; about 1.83 grams of DOWFAX™ 2A1 anionic surfactant; about 398 grams of an amorphous polyester resin emulsion (Amorphous Resin Emulsion C) containing about 17 percent by weight of a linear amorphous propoxylated bisphenol A fumarate polyester resin, about 74.3 grams of a crystalline polyester resin emulsion containing about 20 percent by weight unsaturated crystalline polyester resin derived from of ethylene glycol, dodecanedioic acid and fumaric acid co-monomers with the following formula:

(II)

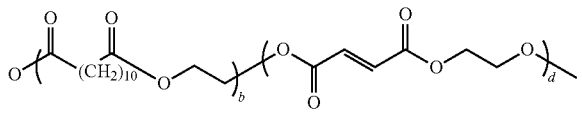

wherein b is from 5 to 2000 and d is from 5 to 2000 in an emulsion (about 19.3 weight % resin), synthesized following the procedures described in U.S. Patent Application Publication No. 2006/0222991, the disclosure of which is hereby incorporated by reference in its entirety; and about 29.2 grams of cyan pigment dispersion containing about 17 percent by weight of Pigment Blue 15:3 pigment. The pH of the mixture was adjusted to about 3.2 using a 0.3 M solution of $HNO_3$. The mixture was stirred using an IKA ULTRA TURRAX® T50 homogenizer operating at a speed of from about 3,500 to about 4,000 revolutions per minute. About 36 grams of a flocculent mixture containing 1 percent by weight solution of $Al_2(SO_4)_3$ was added dropwise to the mixture. The mixture was subsequently transferred to a 2 liter stainless steel Buchi reactor, and heated to about 40 to 46° C. for aggregation at about 750 revolutions per minute. The particle size was monitored with a Coulter Counter until the core particles reach a volume average particle size of about 6.83 micrometers and a GSDv of about 1.21.

Subsequently, about 1.43 grams of DOWFAX™ 2A1 anionic surfactant and about 198.3 grams of Amorphous Resin Emulsion C adjusted to a pH of about 3.2 were added to the reactor mixture to further aggregate until the particles reached a volume average particle size of about 8.33 micrometers and a GSDv of about 1.21. Thereafter, the pH of the toner slurry was increased to about 6.7 using 1.0 M NaOH followed by the addition of about 1.39 grams of a chelating solution containing about 39 percent by weight EDTA to freeze the toner growth. After freezing, the reactor mixture was heated to about 69° C. to enable the toner particles to coalesce and spherodize. The reactor heater was then turned off and the reactor mixture was cooled to room temperature over a period of about 90 minutes, and then filtered through a 25 micrometer sieve, washed and dried.

The final toner had a volume average particle size diameter of about 8.07 micrometers, a GSDv of about 1.22 as measured by a Coulter Counter, and a circularity of about 0.976 as measured with a SYSMEX® FPIA-2100 flow-type histogram analyzer.

Charging and fusing data are set forth below in Tables 3 and 4 respectively.

Example 3

Toner without Wax and with CCA

This Example synthesized a polyester emulsion aggregation toner not including a wax, but including the CCA dispersion from Example 1. The following components were added to a 2 liter glass beaker: about 271.2 grams of deionized water; about 1.83 grams of DOWFAX™ 2A1 anionic surfactant; about 398.2 grams of an amorphous polyester resin emulsion (Amorphous Resin Emulsion C) containing about 17.0 percent by weight of a linear amorphous propoxylated bisphenol A fumarate polyester resin, about 84.65 grams of a crystalline polyester resin emulsion containing about 19.3 percent by weight unsaturated crystalline polyester resin derived from of ethylene glycol, dodecanedioic acid and fumaric acid herein; and about 29.2 grams of cyan pigment dispersion containing about 17 percent by weight of Pigment Blue 15:3 pigment. The pH of the mixture was adjusted to about 3.2 using a 0.3 M solution of $HNO_3$. The mixture was stirred using an IKA ULTRA TURRAX® T50 homogenizer operating at a speed of from about 3,500 to about 4,000 revolutions per minute. About 36 grams of a flocculent mixture containing 1 percent by weight solution of $Al_2(SO_4)_3$ was added dropwise to the mixture. The mixture was subsequently transferred to a 2 liter stainless steel Buchi reactor, and heated to about 40° C. for aggregation at about 750 revolutions per minute. The particle size was monitored with a Coulter Counter until the core particles reach a volume average particle size of about 7.19 micrometers and a GSDv of about 1.25.

Subsequently, about 1.43 grams of DOWFAX™ 2A1 anionic surfactant, about 189.7 grams of Amorphous Resin Emulsion C adjusted to a pH of about 3.2, and about 6.7 grams of the CCA dispersion from Example 1 were added to the reactor mixture to further aggregate until the particles reached a volume average particle size of about 8.33 micrometers and a GSDv of about 1.21. Thereafter, the pH of the toner slurry was increased to about 6.2 using about 1 M NaOH followed by the addition of about 1.39 grams of a chelating solution containing about 39 percent by weight EDTA to freeze the toner growth. After freezing, the reactor mixture was heated to about 69° C. to enable the toner particles to coalesce and spherodize. The reactor heater was then turned off and the reactor mixture was cooled to room temperature over a period of about 90 minutes, and then filtered through a 25 micrometer sieve, washed and dried.

The final toner had a volume average particle size diameter of about 7.99 micrometers, a GSDv of about 1.22 as measured by a Coulter Counter, and a circularity of about 0.966 as measured with a SYSMEX® FPIA-2100 flow-type histogram analyzer.

Since the EDTA was a chelating agent, a determination was made of the zinc concentration in the final toner and in the first wash filtrate with a Thermo Electron iCAP 6500 ICP spectrometer, the results of which are summarized below in Table 1. Charging and fusing data are set forth below in Tables 3 and 4 respectively.

TABLE 1

Zn concentration in toner and wash filtrate as measured by ICP.

| | Zn concentration in toner (ppm) | Zn concentration in wash filtrate (ppm) | Zn weight in toner (g) | Zn weight in wash filtrate (g) |
|---|---|---|---|---|
| Toner of Example 2 | 21 | >74 | 0.003 | >0.072 |
| Toner of Example 3 | 363 | 78 | 0.044 | 0.077 |

For both toners, there were significant amounts of zinc removed from the toners as shown in Table 1. While not wishing to be bound by any theory, it is possible that the EDTA was the primary driver for zinc removal. The above results demonstrate the benefits of using CCA in these toner formulations.

Charging data for the toners of Comparative Examples 1 and 2, and Examples 2 and 3, are provided in Tables 2 and 3 below. Developers for bench charging evaluations were prepared by using 100 grams of 65 micrometer PMMA coated iron carrier and 4.5 grams of toner. The developer toner concentration is 4.5 parts per hundred. Two developers were prepared and conditioned in two chambers with different zone conditions, the A-zone chamber with a temperature and RH settings of 28° C. and 85 percent RH and the C-zone chamber with a temperature and RH settings of 12° C. and 15 percent RH. Developer charging was done in two steps, a short 5 minutes and a long 60 minutes paint shaking time. Desirably, a stable charge is attained in a short time and maintained at this level with minimal change with increasing charging time.

Heat cohesion data for the toners of comparative Examples 1 and 2 and Examples 2 and 3 are also provided in Tables 2 and 3 below. About two gram samples of toner containing additives were weighted separately into an open dish and conditioned in an environmental chamber at specified temperatures and 50 percent relative humidity. After 17 hours each the samples were removed and acclimated in ambient room conditions for 30 minutes. Each re-acclimated sample was measured by sieving through a stack of two pre-weighed mesh sieves, which were stacked as follows: 1000 micrometers on top and 106 micrometers on bottom. The sieves were vibrated for 90 seconds at 1 millimeter amplitude with a Hosokawa flow tester. After the vibration was completed the sieves were reweighed and toner heat cohesion was calculated from the total amount of toner remaining on both sieves as a percentage of the starting weight. Heat Cohesion (HC) Onset Temperature is the temperature below which substantially no toner remains on the sieves after vibration.

TABLE 2

Charging performance of toners containing wax

| | A-zone | | | C-zone | | HC Onset |
|---|---|---|---|---|---|---|
| Sample ID | 60' Q/d | 60' Q/m | 2' Q/m | 60' Q/d | 60' Q/m | Temp (° C.) |
| EA toner without CCA (Comparative Example 1) | 8.8 | 30.8 | 36.1 | 14.3 | 48.7 | 50.8 |
| EA toner with CCA (Example 2) | 8.5 | 37.2 | 42.6 | 14.7 | 53.5 | 52.0 |

Q/d = Toner charge divided by diameter of toner particle
Q/m = Toner charge per mass ratio
HC = Heat cohesion As can be seen in Table 2, the addition of CCA in the EA toner formulation had a very beneficial effect on charging in both A-zone and C-zone. Similarly, the CCA improved the Heat Cohesion Onset Temperature as compared to the toner without CCA.

TABLE 3

Charging performance of toners without wax

| | A-zone | | C-zone | |
|---|---|---|---|---|
| Sample ID | Q/m (5 min) | Q/m (60 min) | Q/m (5 min) | Q/m (60 min) |
| EA toner without CCA (Comparative Example 2) | 3.7 | 3.6 | 16.7 | 13.8 |
| EA toner with CCA (Example 3) | 6.2 | 4.1 | 28.3 | 33.7 |

As can be seen in Table 3, the beneficial effect obtained by the addition of CCA in the EA toner formulation included a very significant effect on parent toner charging, especially in the C-zone.

To summarize, charging performance of EA toners, both containing wax and no wax, was significantly improved by the incorporation of CCA in the shell of said toners during the aggregation coalescence process as demonstrated by the charging results.

For fusing, there was insufficient toner from Example 2 to carry out a fusing evaluation. Therefore, only fusing results for the toners of Comparative Example 2 and Example 3 are presented in Table 4 below. The fusing data was generated by the following method. Unfused test images were made using a Xerox Corporation DC12 color copier/printer. Images were removed from the printer/copier before the document passed through the fuser. These unfused test samples were then fused using a Xerox Corporation iGen3® fuser. Test samples were directed through the fuser at 100 prints per minute. Fuser roll temperature was varied during the experiments so that gloss and crease area could be determined as a function of the fuser roll temperature. Print gloss was measured using a BYK Gardner 75 degree gloss meter. Gloss 40 Temperature is the temperature at which the gloss equals 40 gloss units. Toner adhesion to the paper was determined by its crease fix Minimum Fusing Temperature (MFT). The fused image was folded and an 860 gram weight of toner was rolled across the fold after which the page was unfolded and wiped to remove the fractured toner from the sheet. This sheet was then scanned using an Epson flatbed scanner and the area of toner which had been removed from the paper was determined by image analysis software such as the National Instruments IMAQ.

TABLE 4

Fusing performance of toners without wax (Examples 4 and 5)

| Sample ID | MFT (° C.) | $T_{G40}$ (° C.) |
|---|---|---|
| EA toner without CCA (Comparative Example 2) | 136 | 139 |
| EA toner with CCA (Example 3) | 148 | 151 |

MFT = Minimum fusing temperature
$T_{G40}$ = Gloss 40 temperature

As can be seen from Table 4 above, the addition of CCA to the EA toner formulation had only a moderate effect on fusing performance; wherein the MFT increased only by about 12° C. which is still within acceptable limits. Likewise, a moderate increase in Gloss 40 Temperature was noted.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

contacting at least one amorphous resin with at least one crystalline resin in an emulsion to form small particles, wherein the emulsion includes an optional colorant, an optional surfactant, and an optional wax;

aggregating the small particles to form a plurality of larger aggregates;

passing at least one charge control agent in a dispersion through a high energy disperser at a pressure of from about 3,000 pounds per square inch to about 30,000 pounds per square inch to form a first charge control dispersion;

combining the first charge control dispersion with an emulsion or dispersion possessing at least one resin to form a second charge control dispersion;

contacting the larger aggregates with the second charge control dispersion to form a resin coating thereon;

coalescing the larger aggregates to form toner particles; and recovering the toner particles.

2. A process according to claim 1, wherein the at least one amorphous resin comprises a polyester resin, and the high energy disperser is selected from the group consisting of including high pressure homogenizers, high shear dispersers, high shear processors, high energy stator/rotor mixers, impeller mills, agitators, blenders, ball mills, pebble mills, attritors, small-media mills, sand mills, vibratory mills, multiple roll mills, ultrasonic dispersers, and combinations thereof.

3. A process according to claim 1, wherein the at least one amorphous resin is derived from the reaction of a diacid or diester selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, trimellitic acid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof, and a diol selected from the group consisting of 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof; and wherein the at least one crystalline resin is derived from the reaction of at least one diol selected from the group consisting of 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, and combinations thereof, with at least one diacid or diester selected from the group consisting of oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, polyimides, polyolefins, ethylene-propylene copolymers, ethylene-vinyl acetate copolymers, and combinations thereof.

4. A process according to claim 1, wherein the charge control agent is selected from the group consisting of organic complexes and organometallic complexes.

5. A process according to claim 4, wherein the charge control agent is selected from the group consisting of azometal complexes, monoazo metal compounds, copper phthalocyanine complexes, carboxylic acids, substituted carboxylic acids, metal complexes of carboxylic acids, salicylic acid, substituted salicylic acid, metal complexes of salicylic acids, metal complexes of alkyl-aromatic carboxylic acids, zinc compounds of alkylsalicylic acid derivatives, naphthoic acids, substituted naphthoic acids, metal complexes of naphthoic acids, hydroxycarboxylic acids, substituted hydroxycarboxylic acids, metal complexes of hydroxycarboxylic acids, dicarboxylic acids, substituted dicarboxylic acids, metal complexes of dicarboxylic acids, nitroimidazole derivatives, boron complexes of benzilic acid, calixarene compounds, metal carboxylates, sulfonates, metal sulfonates, sulfone complexes, complexes of dimethyl sulfoxide with metal salts, calcium salts of organic acid compounds having one or more acid groups, barium salts of sulfoisophthalic acid compounds, polyhydroxyalkanoates possessing substituted phenyl units, acetamides, benzenesulfonamides, Nigrosine compounds, triphenylmethane-based compounds containing a tertiary amine as a side chain, quaternary ammonium salt compounds, alkyl pyridinium halides, alkyl pyridinium compounds, organic sulfates, organic sulfonates, bisulfates, quaternary ammonium nitrobenzene sulfonates, polyamine resins, guanidine derivatives, imidazole derivatives, and combinations thereof.

6. A process according to claim 4, wherein the charge control agent is selected from the group consisting of amorphous iron complex salts having a monoazo compound as a ligand, azo-type iron complexes, 3,5-di-tert-butylsalicylic acid, zirconium complexes 3,5-di-t-butylsalicylic acid zinc compounds of 3,5-di-tert-butylsalicylic acid, zinc dialkyl salicylic acid, boro bis(1,1-diphenyl-1-oxo-acetyl potassium salt), zirconium complexes of 2-hydroxy-3-naphthoic acid, metal compounds having aromatic dicarboxylic acids as ligands, potassium borobisbenzylate, styrene-acrylate-based copolymers with sulfonate groups, styrene-methacrylate-based copolymers with sulfonate groups, complexes of dimethyl sulfoxide with metal salts, N-substituted 2-(1,2-benzisothiazol-3(2H)-ylidene 1,1-dioxide)acetamide, N-(2-(1,2-benzisothiazol-3(2H)-ylidene 1,1-dioxide)-2-cyanoacetyl) benzenesulfonamide, cetyltrimethylammonium bromide, cetyl pyridinium tetrafluoroborates, distearyl dimethyl ammonium methyl sulfate, distearyl dimethyl ammonium bisulfate, and combinations thereof.

7. A process according to claim 1, wherein the emulsion further comprises the charge control dispersion.

8. A process according to claim 1, wherein the charge control agent is present in the toner particles in an amount of from about 0.1 percent by weight of the toner particles to about 10 percent by weight of the toner particles.

9. A process according to claim 1, wherein the optional colorant comprises dyes, pigments, combinations of dyes, combinations of pigments, and combinations of dyes and pigments, in an amount of from about 0.1 to about 35 percent by weight of the toner.

10. A process according to claim 1, wherein the optional wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from about 1 weight percent to about 25 weight percent of the toner.

11. A process according to claim 1, wherein the toner particles are of a size of from about 3 μm to about 20 μm, and have a circularity of from about 0.9 to about 1.

12. A process comprising:

contacting at least one amorphous resin with at least one crystalline resin, an optional colorant, at least one surfactant, and an optional wax to form small particles;

aggregating the small particles to form a plurality of larger aggregates;

forming a first dispersion comprising at least one charge control agent selected from the group consisting of amorphous iron complex salts having a monoazo compound as a ligand, azo-type iron complexes, 3,5-di-tert-butylsalicylic acid, zirconium complexes 3,5-di-t-butylsalicylic acid zinc compounds of 3,5-di-tert-butylsalicylic acid, zinc dialkyl salicylic acid, boro bis(1,1-diphenyl-1-oxo-acetyl potassium salt), zirconium complexes of 2-hydroxy-3-naphthoic acid, metal compounds having aromatic dicarboxylic acids as ligands, potassium borobisbenzylate, styrene-acrylate-based copolymers with sulfonate groups, styrene-methacrylate-based copolymers with sulfonate groups, complexes of dimethyl sulfoxide with metal salts, N-substituted 2-(1,2-benzisothiazol-3(2H)-ylidene 1,1-dioxide) acetamide, N-(2-(1,2-benzisothiazol-3(2H)-ylidene 1,1-dioxide)-2-cyanoacetyl)benzenesulfonamide, cetyltrimethylammonium bromide, cetyl pyridinium tetrafluoroborates, distearyl dimethyl ammonium methyl sulfate, distearyl dimethyl ammonium bisulfate, and combinations thereof;

passing the at least one charge control agent in the first dispersion through a homogenizer at a pressure of from about 15,000 pounds per square inch to about 25,000 pounds per square inch;

combining the at least one charge control agent in the first dispersion with an emulsion or dispersion possessing at least one resin to form a second dispersion comprising the at least one charge control agent;

contacting the larger aggregates with the at least one charge control agent in the second dispersion to form a resin coating thereon;

coalescing the larger aggregates to form toner particles; and recovering the toner particles, wherein the toner particles are of a size of from about 3 micrometers to about 20 micrometers, and have a circularity of from about 0.9 to about 1.

13. A process according to claim 12, wherein the optional colorant comprises dyes, pigments, combinations of dyes, combinations of pigments, and combinations of dyes and pigments in an amount of from about 0.1 to about 35 percent by weight of the toner, and the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate.

* * * * *